United States Patent [19]

Mathers

[11] Patent Number: 5,011,654

[45] Date of Patent: Apr. 30, 1991

[54] PRODUCTION OF FLAT PRODUCTS

[76] Inventor: Roy Mathers, 29 Hawarden Road, Hope, Wrexham, Clwyd, Wales, Great Britain

[21] Appl. No.: 557,961

[22] Filed: Jul. 25, 1990

[30] Foreign Application Priority Data

Jul. 29, 1989 [GB] United Kingdom ..... 8917402

[51] Int. Cl.[5] ..... G22F 5/00

[52] U.S. Cl. ..... 419/3; 419/36; 419/37; 419/40; 419/43

[58] Field of Search ..... 419/3, 36, 37, 40, 43

[56] References Cited

U.S. PATENT DOCUMENTS

| | | | |
|---|---|---|---|
| 3,653,884 | 4/1972 | Davies et al. | 419/40 |
| 3,658,517 | 4/1972 | Davies et al. | 419/36 |
| 3,839,026 | 10/1974 | Gibbon et al. | 419/40 |
| 4,622,189 | 11/1986 | Bellis et al. | 264/112 |

FOREIGN PATENT DOCUMENTS

| | | |
|---|---|---|
| 1087580 | 10/1967 | United Kingdom . |
| 1212681 | 11/1970 | United Kingdom . |
| 1466364 | 3/1977 | United Kingdom . |
| 1528484 | 10/1978 | United Kingdom . |
| 2059443A | 4/1981 | United Kingdom . |

*Primary Examiner*—Stephen J. Lechert, Jr.
*Attorney, Agent, or Firm*—Kinney & Lange

[57] ABSTRACT

A continuous process for producing strip products which comprises forming an aqueous slurry of a mixture of a metal powder and a film-forming cellulose derivative and producing from this slurry a self-supporting strip. This self-supporting strip is fed onto an endless moving belt by which the strip is transported into and through a sinter furnace. A tensile force is applied to the sintered strip in the direction of travel of the strip, and this tensile force is controlled such that the speed at which the strip leaves the furnace is greater than the speed at which the strip enters the furnace by an amount related to the expected or actual increase in strip length occasioned by expansion of the strip during the sintering process.

3 Claims, 1 Drawing Sheet

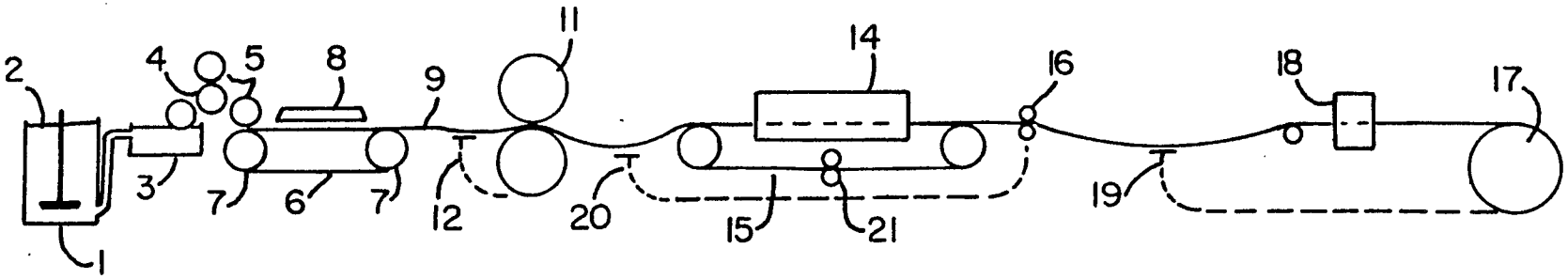
1
2
3
4
5
6
7
7
8
9
11
12
14
15
16
17
18
19
20
21

PRODUCTION OF FLAT PRODUCTS

This invention relates to the production of flat products such as strip or sheet (hereinafter referred to simply as "strip") from a start material consisting essentially of metallic and/or non-metallic particles.

It is known from GB-PS-1212681 to produce strip from metal powder in which a coating of a slurry comprising a suspension of metal powder in a binder composition is deposited onto a support surface, the slurry being dried, removed from the support surface and rolled to form a green strip. In this process, the green strip is subjected to heat treatment within a sinter furnace to cause the particles to coalesce to form a coherent strip product. As it enters the sinter furnace, the strip is conveniently supported by an entry roller and during its travel through the furnace the strip is conveniently supported on a moving endless belt, the speeds of the strip and the belt being substantially identical. These steps are taken to minimise any tensile forces acting on the strip during the sintering process.

It is also well known that when producing metal strip by this process from metallic powders of the same composition and some mixtures of metallic powders of different compositions, the strip length decreases during the sintering process due to shrinkage. Such reductions in strip length have previously been accommodated by means of, for example, a helper roll before the furnace together with suitable strip loop control systems at entry to and exit from the furnace. See for example GB-PS-1466364. The helper roll and loop controls effectively enable the speeds of strip entering and leaving the furnace to be matched to accommodate any reduction in strip length occasioned by shrinkage.

Other examples of producing strip by a process as described above can be found in GB-A-2059443, GB-PS-1528484, U.S. Pat. No. 4,622,189 and GB-PS-1087580. The first three of these documents describe processes for producing strip comprising two or more material layers, individually produced layers being superimposed one on another prior to compaction and sintering. In each case, each individual strip is subjected to tension to ensure correct alignment of the superimposed strips during the compaction stage. In each case, the strip is not subjected to tensile stress during the sintering process; indeed the objective is to sinter the strip under minimal tensile stress conditions. GB-PS-1087580 describes a process in which a dried strip of metallic particles is rolled by a warm compaction process, that is to say at a temperature below the sintering temperature. This is quite distinct from processes as described previously in which sintering is a key step during the strip production process. It is, consequently, the case that processes such as described above have been operated to reduce to a minimum tensile forces imposed in the strip during the sintering stage.

We have now established that for certain mixtures of powders, strip produced from these powders is subject to linear expansion during sintering. We have also established that any increase in strip length, will, unless accommodated, produce in the product widthwise extending ridges which cannot be removed by subsequent processing.

It is known that in a binary alloy lattice, the rates of diffusion of the separate elements are not necessarily equal. This diffusion phenomena is generally referred to as the "Kirkendale effect" and occurs by a vacancy exchange mechanism resulting in a growth of pores during sintering of the alloy. Thus, powder mixtures which exhibit a tendancy to expand during sintering are those in which the Kirkendall effect is greater than the contraction occasioned during sintering. For the sake of clarity, such powder mixtures shall be referred to as "powder mixtures as hereinbefore described".

According to the present invention in one aspect there is provided a continuous process for producing strip products which comprises forming an aqueous slurry of a powder mixture as hereinbefore described and a film-forming cellulose derivative, producing from this slurry a self-supporting strip and feeding this self-supporting strip onto an endless moving belt by which the strip is transported into and through a sinter furnace, the process being characterised by the steps of controlling the speeds at which the strip enters and leaves the furnace in a sense to impose in the strip as it passes through the furnace a tensile force in its direction of travel, the tensile force imposed being related to the expected or actual increase in strip length occasioned by expansion of the strip during the sintering process and being such as to prevent ridging of the strip which would otherwise be caused by such expansion.

According to the present invention in another aspect, there is provided apparatus for producing strip products, the apparatus comprising means for producing a slurry from a powder mixture as hereinbefore described and a film-forming cellulose derivative, means for producing from this slurry a strip, and means for feeding this strip onto an endless belt by which the strip is transported to and through a sinter furnace, the apparatus being characterised by means for controlling the speed at which the strip enters the furnace relative to the speed at which it leaves the furnace such that the latter is greater than the former by an amount related to a predicted increase in strip length occasioned by expansion of the strip during the sintering process.

BRIEF DESCRIPTION OF THE DRAWING

The invention will now be described by way of example only with reference to the accompanying diagrammatic drawing in which the sole FIGURE is a schematic side view of apparatus for operating a process in accordance with the invention.

In the apparatus shown, a suspension of metal powder as hereinbefore described in a binder is mixed thoroughly in a blender 1 to produce a homogeneous slurry 2 which is transferred to a vessel 3. The slurry is conveniently based upon multiples of 300 grams of methyl-cellulose treated with glyoxal as a solubility inhibitor together with 12 liters of water optionally containing suitable slurrying and wetting agents. Typically incorporated in the aqueous methyl-cellulose is 35 kilograms of a powder mix typically of below 80 BS mesh. The concentration of the metal powder in the aqueous slurry is typically approximately 75% by weight although lower or higher concentrations may be used according to the mechanical and/or thermal properties which are required for the final product.

The powder may be produced by any suitable method.

The slurry 2 is transferred by a train of rollers 4 onto a coating roller 5 arranged to deposit a slurry coating of a selected thickness and width onto an endless moving belt 6 looped around rollers 7. The belt is preferably constructed of an inert metal such as stainless steel.

Other means of slurry deposition, for example, curtain coating or extrusion may, however, be employed.

Drive applied to at least one of the rollers 7, feeds the belt 6 through a drying oven 8 initially to raise the temperature of the deposited slurry layer to about 45° C. to promote gelling of the methyl-cellulose and to drive water from the gelled slurry at higher temperatures to dry the strip. Typically, the drying temperature is one which approaches the boiling point of the water of the slurry. This dried coating emerges from the drying oven 8 as a flexible and self-supporting strip 9 which can readily be removed from the surface of the belt 6, the latter being conveniently pre-treated to ensure early release. The flexible self-supporting strip is generally referred to as "flexistrip" and is formed of a homogeneous mix of the blended metallic particles.

The flexistrip passes to the nip of a pair of contra-rotating rolls 11 in which it is compacted. The speed of rotation of the rolls 11 is controlled to ensure that the amount of flexistrip present between the belt 6 and rolls 11 does not exceed a predetermined value. A sensor 12 is positioned below the flexistrip as it approaches the rolls 11 to detect the presence of excessive strip, the rotational speed of the rolls 11 being controlled in response to the sensor 12 to maintain a predetermined loop formation. On leaving the nip of the rolls 11 the flexistrip is fed continuously towards and into the entrance of a sinter furnace 14. As the strip approaches the sinter furnace 14 it is supported on the upper surface of a moving endless belt 15 and is transported through the sinter furnace with its lower surface in contact with the upper surface of the belt 15. The endless belt is produced from an inert material such as stainless steel. As the strip passes through the furnace, the individual particles coalesce one with another to produce a coherent strip.

The sintered strip is drawn from the sinter furnace by means of pinch rolls 16 located at exit from the furnace 14. The strip is then coiled on a coiler 17 prior to compaction and further heat treatments. A tension stand 18 is positioned upstream of the coiler 17. The rotational speed of the coiler 17 is matched to the length of strip between the pinch rolls 16 and the tension stand 18, a sensor 19 being provided below the strip coupled to the drive to the coiler 17 to maintain a given loop formation.

During the sintering process, increases in length of the strip are occasioned because of the previously explained properties of the powder mixture from which it is produced. If this increase in length is not accommodated in some way, ridges or corrugations are produced which extend across partly or the entire width of the strip. In order to prevent these ridges or corrugations being formed, the rotational speed of the exit pinch rolls 16 is controlled in dependence upon signals received from a sensor 20 positioned below the flexistrip as it passes between the compaction rolls 11 and the entrance to the furnace 14. By so doing, the speed of entry of the strip to the furnace is controlled to accommodate the expected or actual increase in strip length as it passes through the furnace having regard to the composition and properties of the powder from which the strip is produced and the temperature extant within the sinter furnace. Thus, the strip is subjected to a force in the general direction of travel of the strip as it travels through the furnace. Additionally, the support belt 15 is driven by pinch rolls 21 and its speed of travel is maintained at a rate equal to or below the travel speed of the sintering strip to impose a further degree of tension on the strip as it travels through the furnace. Typically the belt speed approximates to 90% of the peripheral speed of the pinch rolls 21. This controlled tension assists in eliminating the formation of ridges or corrugations in the strip product.

Control of the entry speed of the strip to the furnace and the travel speed of the endless belt 15 is effected automatically in response to the sensor 20.

The pulling or tensile force applied to the sintered strip may be applied other than by the pinch rolls 16, e.g. by means of the coiler, a rotational drum coated with a friction enhancing material or by any other conventional means. Additionally, the means of sensing and controlling the speed of entry of the strip may take a form other than that described.

Typical of powder mixtures as hereinbefore described include FEROMIX 527, FEROMIX 530 and FEROMIX 538 (FEROMIX is a registered trade mark of the applicants). FEROMIX 527 comprises the following composition by weight:

Cr: 31.5 to 32.5%; Ni: 26.5 to 27.5%; Mn: 3.5 to 4.5%; Si: 0.10 to 0.18%; C: 0.12 to 0.17%; Mo: 0.75% Max; Cu: 0.5% Max; P: 0.010% Max; S: 0.10% Max; Fe: Balance.

FEROMIX 530 comprises the following composition by weight:

Cr: 31.5 to 32.5%; Ni: 26.5 to 27.5%; Mn: 7.0 to 8.0%; Mo: 0.75% Max; Cu: 0.5% Max; Si: 0.10 to 0.15%; C: 0.12 to 0.17%; P: 0.010% Max; S: 0.010% Max; Fe: Balance.

FEROMIX 538 comprises the following composition by weight:

Cr: 26.5 to 27.5%; Ni: 21.5 to 22.5%; Mn: 7.0 to 8.0%; Mo: 0.30 to 0.55%; C: 0.06 to 0.10%; Si: 0.05 to 0.10%; P: 0.005% max; S: 0.005% max; Fe: Balance.

Typically, strip produced from FEROMIX 527 exhibits a linear expansion of 0.3% during sintering and FEROMIX 530, 1.5%.

It is to be understood that the foregoing is merely exemplary of a process in accordance with the invention and that modifications can readily be made thereto without departing from the true scope of the invention.

What is claimed is:

1. A continuous process for producing strip products which comprises forming an aqueous slurry of a powder mixture which exhibit a tendency to expand during sintering and a film-forming cellulose derivative, producing from this slurry a self-supporting strip, feeding this self-supporting strip onto an endless moving belt by which the strip is transported into and through a sinter furnace, and controlling the speeds at which the strip enters and leaves the furnace in a sense to impose in the strip as it passes through the furnace a tensile force in its direction of travel, the tensile force imposed being related to the expected or actual increase in strip length occasioned by expansion of the strip during the sintering process and being such as to prevent ridging of the strip which would otherwise be caused by such expansion.

2. A process as claimed in claim 1 wherein the speed of travel of the moving belt is maintained at a rate equal to or below the travel speed of the sintering strip to impose a degree of tension on the strip as it travels through the furnace.

3. A process as claimed in claim 2 wherein the travel speed of the moving belt approximates to 90% of the travel speed of the sintering strip.

* * * * *